US006764557B2

(12) United States Patent
Sänger et al.

(10) Patent No.: US 6,764,557 B2
(45) Date of Patent: Jul. 20, 2004

(54) METHOD FOR PRODUCING ANGULAR, STAINLESS SHOT-BLASTING ABRASIVES BASED ON AN FE-CR-C ALLOY

(75) Inventors: Reinhard Sänger, Balve (DE); Oliver Zyto, Witten (DE)

(73) Assignee: Vulcan Strahltechnik GmbH, Hattingen (DE)

( * ) Notice: Subject to any disclaimer, the term of this patent is extended or adjusted under 35 U.S.C. 154(b) by 0 days.

(21) Appl. No.: 10/181,825

(22) PCT Filed: Jan. 11, 2001

(86) PCT No.: PCT/EP01/00252

§ 371 (c)(1),
(2), (4) Date: Nov. 5, 2002

(87) PCT Pub. No.: WO01/53022

PCT Pub. Date: Jul. 26, 2001

(65) Prior Publication Data

US 2003/0136224 A1 Jul. 24, 2003

(30) Foreign Application Priority Data

Jan. 22, 2000 (DE) ..... 100 02 738

(51) Int. Cl.[7] ..... C21C 1/08
(52) U.S. Cl. ..... 148/513; 75/352
(58) Field of Search ..... 75/338, 352, 355, 75/360; 148/513

(56) References Cited

U.S. PATENT DOCUMENTS

| | | | | |
|---|---|---|---|---|
| 3,975,186 A | * | 8/1976 | Grebe et al. | |
| 4,448,746 A | * | 5/1984 | Kubo et al. | 419/31 |
| 4,519,852 A | * | 5/1985 | Causton | 148/513 |
| 5,395,463 A | * | 3/1995 | Johnen et al. | 148/513 |
| 6,358,298 B1 | * | 3/2002 | Gagne et al. | 75/243 |

FOREIGN PATENT DOCUMENTS

| | | | |
|---|---|---|---|
| DE | 2813018 A | * | 10/1979 |
| DE | 198 15 087 | | 10/1999 |
| JP | 61 257775 | | 11/1986 |
| JP | 02-274801 | * | 11/1990 |
| WO | WO 92/13664 | | 8/1992 |

* cited by examiner

*Primary Examiner*—George Wyszomierski
(74) *Attorney, Agent, or Firm*—Collard & Roe, P.C.

(57) ABSTRACT

The invention relates to a process for producing a corrosion-resistant blasting agent (>60 HRC) with sharp edges based on an Fe—Cr—C alloy. A granulate consisting of an iron-chromium-carbon alloy is hardened in said process to >60 HRC by subjecting it to a heat treatment at above 900° Celsius under a reducing atmosphere. An oxide-free, hard material is obtained in this way that can be crushed into grains with sharp edges. The result is a blasting agent with excellent properties for the surface treatment of workpieces consisting of corrosion-resistant materials such as, for example stainless steel, nonferrous metals and natural stone.

6 Claims, 1 Drawing Sheet

Figure 1:
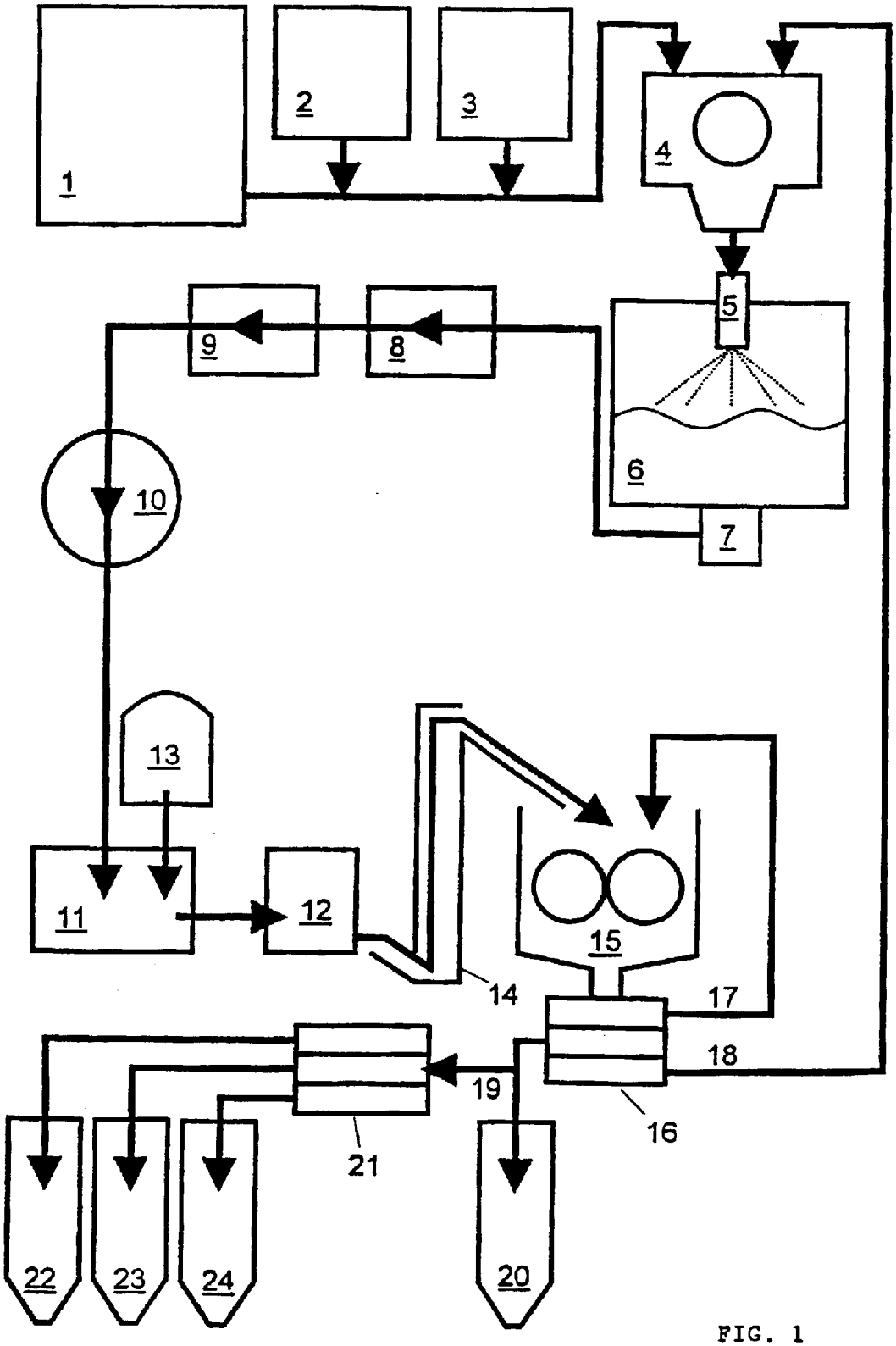

METHOD FOR PRODUCING ANGULAR, STAINLESS SHOT-BLASTING ABRASIVES BASED ON AN FE-CR-C ALLOY

CROSS REFERENCE TO RELATED APPLICATIONS

Applicants claim priority under 35 U.S.C. §119 of German Application No. 100 02 738.5, filed on Jan. 22, 2000. Applicants also claim priority under 35 U.S.C. §365 of PCT/EP01/00252, filed on Jan. 11, 2001. The international application under PCT article 21(2) was not published in English.

The invention relates to a process for producing grains of blasting agents consisting of rustproof cast stainless steel, in which a granulate is produced first from a the melt of an iron-chromium-carbon alloy capable of being hardened. Said alloy is then passed through a heat treatment at >900° C. for hardening it, and subsequently crushed to grains with sharp edges.

For the blasting treatment of workpieces consisting of stainless materials it is necessary to employ stainless blasting agents as well because rusting blasting agents such as steel shot or steel gravel leave iron-containing residues on the surface of the workpiece. Due to the oxidation of adhering iron residues, undesirable stains of rust then appear within a very short time. In addition to nonmetallic, mostly mineral blasting agents such as, for example electrocorundum, silicon carbide or glass, stainless metallic blasting agents are known as well. To be mentioned in this connection is stain steel blasting shot consisting of corrosion-resisting steel alloys. Such material offers a number of advantages vis-à-vis the mineral blasting agents. For example, a substantially prolonged useful life can be achieved with the metallic blasting grains on the usual blasting equipment because the stainless steel, by virtue of its greater ductility, is crushed in the course of the blasting treatment to a substantially lesser degree. Stainless steel blasting agents have been successfully employed especially when used in blasting plants equipped with centrifugal wheels because of their good wear properties conditioned by its high impact strength.

Two categories of blasting agents consisting of non-corrosive cast stain less are known. These are granulates consisting of spherical grains that are made of steel materials with medium hardness (<45 HRC), on the one hand. As disclosed in JP 61 257 775, on the other hand, grains having sharp edges and consisting of hardened cast chromium iron (>60 HRC) are employed because enhanced abrasion properties can be achieved with such grains.

Substantially higher manufacturing expenditure and additional process steps are required in the manufacture of the hardened granulate with sharp edges vis-à-vis the blasting agent grains of the first category. In the manufacturing process according to JP 61 257 775, a granulate consisting of substantially round grains is produced first based on a melt of a chromium-cast iron alloy that is capable of hardening. Said granulate is hardened by quenching it at 1000° C. to 1100° C. in water, following a thermal treatment. The grains are subsequently crushed, so that a material with sharp edges is obtained.

The drawback of said method is that the undesirable oxidation of the material is favored by quenching the hot steel in water, said steel having a temperature of more than 1000° C. Furthermore, the achievable cooling rate is highly limited when water is used (steam phase). However, effective quenching is absolutely required in order to obtain a material that is as brittle as possible. This is the precondition that has to be satisfied so that the grains can be crushed later in such a way that the desired granulate with sharp edges is produced.

The present invention is accordingly based on the problem of providing a process for producing corrosion-proof blasting agents, in which oxidation of the granulate can be excluded during and after the final heat treatment, and in which the brittleness of the material achieved in the hardening step is adequately high for crushing the blasting grains with simple means to obtain a granulate with sharp edges.

Said problem is solved in conjunction with a production process of the type specified above in that the thermal treatment is carried out at >900° Celsius in a reducing atmosphere, and in that a reducing gas or gas mixture is used in the subsequent cooling step as well.

Owing to the fact that the granulate is exclusively subjected to a reducing atmosphere in the hardening phase, the advantage ensues that undesirable oxidation of the material is reliably avoided.

The reducing atmosphere usefully is a gas mixture that contains hydrogen and nitrogen. It has been found in practical life that a gas mixture containing from 60% to 80% hydrogen and from 20% to 40% nitrogen is particularly suited for the process as defined by the invention. The best results were achieved with 70% hydrogen and 30% nitrogen.

Special process steps have to be maintained in order to produce blasting agents from a cast iron-chromium alloy. The use of an iron-chromium-carbon alloy with at least 2% carbon and at least 30% chromium results in a material that can be hardened in a corrosion-resistant manner, whereby degrees of hardening of >60 HRC can be achieved without problems. A material is obtained in this way that is characterized by high resistance to oxidation and excellent resistance to wear. The use of the alloy specified above is therefore especially useful in the process as defined by the invention because it offers the combination of a material that can be hardened in a good way and is resistant to corrosion at the same time.

For crushing the hardened granulate it is useful if a pulsed mill is employed. A tubular oscillating mill is particularly suited for producing from the hardened starting material the desired granulate with sharp edges.

If the blasting agent is employed for the surface treatment of metallic workpieces it is useful if it is present classified according to grain size. The production process as defined by the invention can be followed for such a treatment by an additional process step downstream for fractionating the grains. The adjustment of the desired grain mixture is achieved with an extra process step.

The process as defined by the invention is explained in greater detail in the following with the help of the drawing.

The drawing shows a flow diagram of the production process, whereby the upper part of the drawing comprises the process steps for producing the starting granulate, whereas the lower part shows the process steps hardening, crushing and classifying.

The starting material for the blasting agent is steel scrap that is fed into the production process from a shot storage bin 1. Carbon in the form of the graphite 2 and the chromium 3 is added from suitable supply reservoirs for adjusting the desired alloy. The raw material mixture is subsequently melted to an alloy in a melting furnace 4. Said alloy contains 2.0% carbon and 30% to 32% chromium.

The melt passes through an atomizing device 5 at a temperature in excess of 1420° Celsius, whereby a granulate with a wide spectrum of different grain sizes is produced. The atomized droplets of the metal melt are quenched in a water bath, so that a solid granulate is collected on the bottom of a granulating trough 6.

The granulate is withdrawn from the trough via an outlet 7 and passes through the process steps 8, "dripping off", and 9, "drying". After passing through a cooling stage 10, the starting material for the corrosion-resistant cast chromium alloy is present.

The starting material is now charged in a furnace 11, in which it is annealed at low pressure and at over 900° Celsius in an atmosphere 13 of hydrogen and nitrogen, and is cooled subsequently thereto. Thereafter, it is conveyed into a supply container 12. Annealing of the granulate at >900° C. causes separation of secondary carbides from the alloy-rich matrix, which changes the composition of the matrix. Conversion into martensite is possible only by separating the secondary carbides, which then leads to an increase in the hardness to >60 HRC when the granulate is cooled down from temperature of >900° C.

From the container 12 the granulate is fed into the crusher 15 by a bucket mechanism 14. The crusher 15 is preferably realized in the form of a tubular oscillating mill, and crushes the hardened, brittle granulate to fractured bodies with sharp edges. By employing such pulsed mills it is possible in a particularly good way to break up the material, which is under strong inner tension, into fragments with sharp edges. The grain mixture produced during crushing has a wide distribution of different grain sizes. For classifying purposes, the grain mixture now passes through a screening plant 16. The excessively coarse, oversized grains 17 are recycled into the crusher. The excessively fine, undersized grains 18 are removed from the process at this point and melted down in the melting furnace 4. The good grains 19 with a diameter of between 0.1 and 0.8 mm are either stored in a storage bin 20 or charged in another screening plant 21 for fine classifying. Blasting agents each having different grain sizes are stored in the storage bins 22, 23 and 24, until they are removed for shipment to the final consumers.

What is claimed is:

1. A process for producing blasting agent grains from non-corrosive cast stainless steel comprising the steps of:

(a) producing a granulate from a melt of an iron-chromium-carbon alloy capable of hardening and containing at least 2% carbon and at least 30% chromium;

(b) passing said granulate through a thermal treatment in a reducing atmosphere at >900° Celsius for hardening;

(c) subsequently crushing said granulate into grains with sharp edges; and (d) cooling said grains in a reducing atmosphere.

2. The process according to claim 1, wherein the reducing atmosphere is a gas mixture containing hydrogen and nitrogen.

3. The process according to claim 1, wherein the granulate is crushed by means of a pulsed mill.

4. The process according to claim 3 wherein the pulsed mill is a tubular oscillating mill.

5. The process according to claim 1 further comprising the step of carrying out grain fractioning to set various grain mixtures after cooling said grains.

6. A process for producing blasting agent grains from non-corrosive cast stainless steel comprising the steps of:

(a) producing a granulate from a melt of an iron-chromium-carbon alloy capable of hardening;

(b) passing said granulate through a thermal treatment in a reducing atmosphere at >900° Celsius for hardening;

(c) subsequently crushing said granulate into grains with sharp edges; and (d) cooling said grains in a reducing atmosphere comprising from 60% to 80% hydrogen and from 20% to 40% nitrogen.

* * * * *

UNITED STATES PATENT AND TRADEMARK OFFICE

CERTIFICATE OF CORRECTION

PATENT NO. : 6,764,557 B2
DATED : July 20, 2004
INVENTOR(S) : Sanger et al.

It is certified that error appears in the above-identified patent and that said Letters Patent is hereby corrected as shown below:

Title page,
Item [73], Assignee, should read -- Vulkan Strahltechnik GmbH --.

Signed and Sealed this

Twenty-seventh Day of September, 2005

JON W. DUDAS
*Director of the United States Patent and Trademark Office*